US009157668B2

(12) United States Patent
Xu

(10) Patent No.: US 9,157,668 B2
(45) Date of Patent: Oct. 13, 2015

(54) DOUBLE INLET TYPE PULSE TUBE REFRIGERATOR

(75) Inventor: Mingyao Xu, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 823 days.

(21) Appl. No.: 12/824,195

(22) Filed: Jun. 27, 2010

(65) Prior Publication Data

US 2011/0000225 A1 Jan. 6, 2011

(30) Foreign Application Priority Data

Jul. 3, 2009 (JP) ..... 2009-159018

(51) Int. Cl.
*F25B 9/00* (2006.01)
*F25B 9/14* (2006.01)
*F25B 9/10* (2006.01)

(52) U.S. Cl.
CPC . *F25B 9/145* (2013.01); *F25B 9/10* (2013.01); *F25B 2309/14241* (2013.01)

(58) Field of Classification Search
CPC ..... F25B 9/10; F25B 9/14; F25B 9/145; F25B 2309/14241; F25B 2309/1418; F25B 2309/1427; F25B 2309/14181; F25B 2309/1424; F25B 2309/1411
USPC ..... 62/6, 520
See application file for complete search history.

(56) References Cited

U.S. PATENT DOCUMENTS

| | | | | | |
|---|---|---|---|---|---|
| 5,974,807 | A * | 11/1999 | Gao et al. | ..... | 62/6 |
| 6,094,921 | A * | 8/2000 | Zhu et al. | ..... | 62/6 |
| 6,256,998 | B1 * | 7/2001 | Gao | ..... | 62/6 |
| 6,279,324 | B1 * | 8/2001 | Zhu et al. | ..... | 62/6 |
| 6,351,954 | B1 * | 3/2002 | Nogawa et al. | ..... | 62/6 |
| 6,629,418 | B1 * | 10/2003 | Gao et al. | ..... | 62/6 |
| 2001/0032469 | A1 * | 10/2001 | Zhu et al. | ..... | 62/6 |
| 2005/0274124 | A1 * | 12/2005 | Wang | ..... | 62/6 |

FOREIGN PATENT DOCUMENTS

| | | | | |
|---|---|---|---|---|
| JP | 3800577 | * 12/1999 | ..... | F25B 9/00 |
| JP | 2001-272126 | 10/2001 | | |
| JP | 2002-061976 | 2/2002 | | |
| JP | 3800577 | 7/2006 | | |

* cited by examiner

*Primary Examiner* — Mohammad M Ali
*Assistant Examiner* — Christopher R Zerphey
(74) *Attorney, Agent, or Firm* — IPUSA, PLLC

(57) ABSTRACT

A double inlet type pulse tube refrigerator includes a regenerator having a high temperature end and a low temperature end; a pulse tube having a high temperature end and a low temperature end connected to the low temperature end of the regenerator; a compressor having a high pressure supplying side and low pressure receiving side for a coolant, a bypass pipe having a double inlet valve, the bypass pipe being configured to connect the high temperature end of the pulse tube and the high temperature end of the regenerator; a buffer tank connected to the high temperature end of the pulse tube via a first pipe having a first flow path resistance member; and a second pipe having a second flow path resistance member including a third opening and closing valve.

4 Claims, 8 Drawing Sheets

DOUBLE INLET TYPE PULSE TUBE REFRIGERATOR

CROSS-REFERENCE TO RELATED APPLICATIONS

This patent application is based upon and claims the benefit of priority of Japanese Patent Application No. 2009-159018 filed on Jul. 3, 2009 the entire contents of which are incorporated herein by reference.

BACKGROUND OF THE INVENTION

1. Field of the Invention

The present invention generally relates to pulse tube refrigerators. More specifically, the present invention relates to a double inlet type pulse tube refrigerator.

2. Description of the Related Art

Conventionally, a pulse tube refrigerator has been used for cooling an apparatus requiring a cryogenic temperature environment, such as a MRI (magnetic resonance imaging) apparatus.

In the pulse tube refrigerator, a cryogenic state is formed at low temperature ends of a regenerator and a pulse tube by repeating operations where coolant gas (for example, helium gas) as operating fluid compressed by a compressor flows into the regenerator and into the pulse tube and operations where the operating fluid flows out from the regenerator and into the pulse tube and is received by the compressor. In addition, by placing a cooling subject in thermal contact with these low temperature ends, it is possible to remove heat from the cooling subject.

In particular, a double inlet type pulse tube has a high cooling efficiency and therefore is expected to be applied to various fields.

FIG. 1 is a schematic view of a related art single stage double inlet type pulse tube refrigerator. The related art double inlet type pulse tube refrigerator includes a compressor 12, a regenerator 40 having a high temperature end 42 and a low temperature end 44, a pulse tube 50 having a high temperature end 52 and a low temperature end 54, and a buffer tank 70. The low temperature end 44 of the regenerator 40 and the low temperature end 54 of the pulse tube 50 are connected to each other by a connecting pipe 56.

A coolant flow path 13A at a high pressure (supply) side and a coolant flow path 13B at a low pressure (receiving) side are connected to the compressor 12. The coolant flow path 13A at the high pressure side of the compressor 12 includes a common pipe 20 and a high pressure side pipe 15A where an opening and closing valve V1 is connected. The coolant flow path 13A is connected to the high temperature end 42 of the regenerator 40. In addition, a coolant flow path 13B at the low pressure side of the compressor 12 includes the common pipe 20 and a low pressure side pipe 15B where an opening and closing valve V2 is connected. The coolant flow path 13B is connected to the high temperature end 42 of the regenerator 40.

The high temperature end 52 of the pulse tube 50 is connected to the buffer tank 70 via a pipe 61 having an orifice 60. In addition, the common pipe 20 and the pipe 61 are connected to each other via a bypass pipe 65 having a double inlet valve 63.

In the double inlet type pulse tube refrigerator 10 having the above-discussed structure, by properly operating the opening and closing valves V1 and V2, pressure waves are supplied into the pulse tube 50 via the regenerator 40 and the connecting pipe 56. Compression and expansion are repeated in the pulse tube 50 so that a cryogenic state is formed. The formed cryogenic state is regenerated by the regenerator 40. In addition, by controlling phases of compression and expansion of the coolant gas in the pulse tube 50, it is possible to efficiently form the cryogenic state in the pulse tube 50.

However, in the double inlet type pulse tube refrigerator 10, in a supplying step/receiving step of the coolant gas, a secondary flow (indicated by an arrow L in FIG. 1) of the coolant gas may be easily generated due to an imbalance of a flow amount of the coolant gas flowing through the double inlet valve 63. The secondary flow of the coolant gas circulates in, for example, a closed circuit formed by the bypass pipe 65 having the double inlet valve 63, the pulse tube 50, the connecting pipe 56, and the regenerator 40. Such a secondary flow is a flow in a single direction and may cause reduced heat transfer. Hence, if the secondary flow is generated, the cooling capacity of the refrigerator may be drastically reduced.

In order to prevent generation of the secondary flow, a structure of a double inlet type pulse tube refrigerator shown in FIG. 2 is suggested. See, for example, Japanese Patent No. 3800577.

FIG. 2 is a schematic view of another related art double inlet type pulse tube refrigerator 10'. As shown in FIG. 2, in the double inlet type pulse tube refrigerator 10' compared to the above-discussed double inlet type pulse tube refrigerator 10, another pipe 74 having an orifice 72 is provided between the buffer tank 70 and the coolant flow path 133 at the low pressure side of the compressor 12.

Under this structure, in the receiving step of the coolant gas, the coolant gas in the pulse tube 50 flows toward the compressor 12 via the following three flow paths. That is, (1) The pulse tube 50—the bypass tube 65—the common pipe 20—the low pressure side pipe 15B—the compressor 12;

(2) The pulse tube 50—the connecting pipe 56—the regenerator 40—the common pipe 20—the low pressure side pipe 15B—the compressor 12; and (3) The pipe 61—the buffer tank 70—the other pipe 74—the compressor 12.

Accordingly, with the structure shown in FIG. 2, it may be possible to prevent generation of the secondary flow circulating in the closed circuit mentioned above.

SUMMARY OF THE INVENTION

One aspect of the embodiments of the present invention may be to provide a double inlet type pulse tube refrigerator, including: a regenerator having a high temperature end and a low temperature end; a pulse tube having a high temperature end and a low temperature end, the low temperature end being connected to the low temperature end of the regenerator; a compressor having a high pressure supplying side and low pressure receiving side for a coolant, wherein the high pressure supplying side is connected to the high temperature end of the regenerator via a coolant supplying path having a first opening and closing valve, and the low pressure supplying side is connected to the high temperature end of the regenerator via a coolant receiving path having a second opening and closing valve; a bypass pipe having a double inlet valve, the bypass pipe being configured to connect the high temperature end of the pulse tube and the high temperature end of the regenerator; a buffer tank connected to the high temperature end of the pulse tube via a first pipe having a first flow path resistance member; and a second pipe having a second flow path resistance member including a third opening and closing valve, wherein the second pipe is provided between the compressor and the buffer tank or the first pipe; and the third opening and closing valve is configured to be opened and closed corresponding to an opening state and closing state of the first opening and closing valve.

Additional objects and advantages of the embodiments are set forth in part in the description which follows, and in part will become obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

Figure 2:
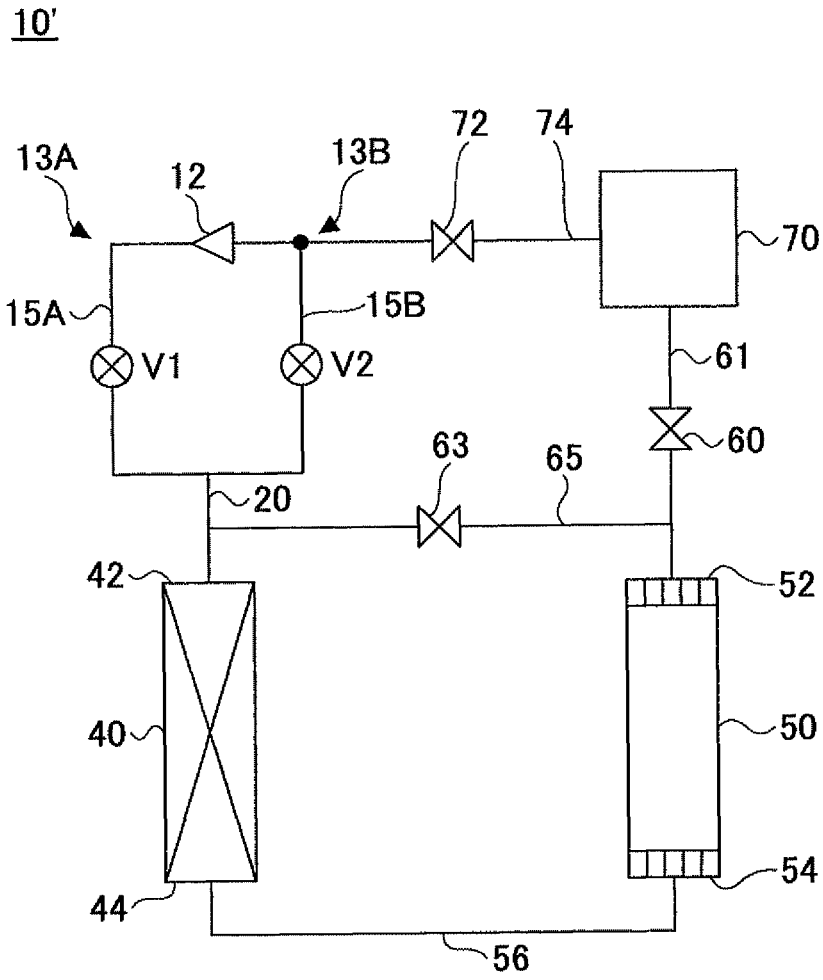
FIG.2 RELATED ART
FIG. 2 is a schematic view of another related art double inlet type pulse tube refrigerator.

The structure shown in FIG. 2 may have the following problems.

In the supply step of the coolant gas, when the opening and closing valve V1 is opened, a part of the coolant gas passes through the bypass pipe 65 so as to be supplied from the high temperature end 52 of the pulse tube 50 to the pulse tube 50. In addition, the remaining coolant gas is passed from the compressor 12 to the regenerator 40 via the coolant flow path 13A at the high pressure side so that heat is exchanged with a regenerator material in the regenerator 40. The coolant gas where the heat is exchanged (which is cooled) passes through the connecting pipe 56 so as to be supplied from the low temperature end 54 of the pulse tube 50 to the pulse tube 50.

In the double inlet type pulse tube refrigerator 10' shown in FIG. 2, the other pipe 74 having the orifice 72 is connected between the buffer tank 70 and the coolant flow path 13B at the low pressure side of the compressor 12. Because of this, the part of the coolant gas which is cooled by the regenerator 40 and introduced into the pulse tube 50 passes through the pipe 61, the buffer tank 70 and the other pipe 74 so as to be discharged toward the compressor 12 before working in a next receiving step. Such a phenomenon may cause reduction of cooling efficiency of the regenerator 40.

The reduction of the cooling efficiency of the regenerator 40 may cause the reduction of the cooling capacity of the pulse tube refrigerator 10'. In addition, it is necessary to increase the amount of high pressure coolant gas supplied from the compressor 12 in the supply step so that the cooling efficiency of the pulse tube refrigerator 10' is decreased.

Accordingly, embodiments of the present invention may provide a novel and useful double inlet type pulse tube refrigerator solving one or more of the problems discussed above.

More specifically, the embodiments of the present invention may provide a double inlet type pulse tube refrigerator whereby it is possible to prevent generation of secondary flow without decreasing the cooling efficiency of the entire apparatus.

A description is given below, with reference to the FIG. 3 through FIG. 8 of embodiments of the present invention.

First Embodiment

Figure 3:
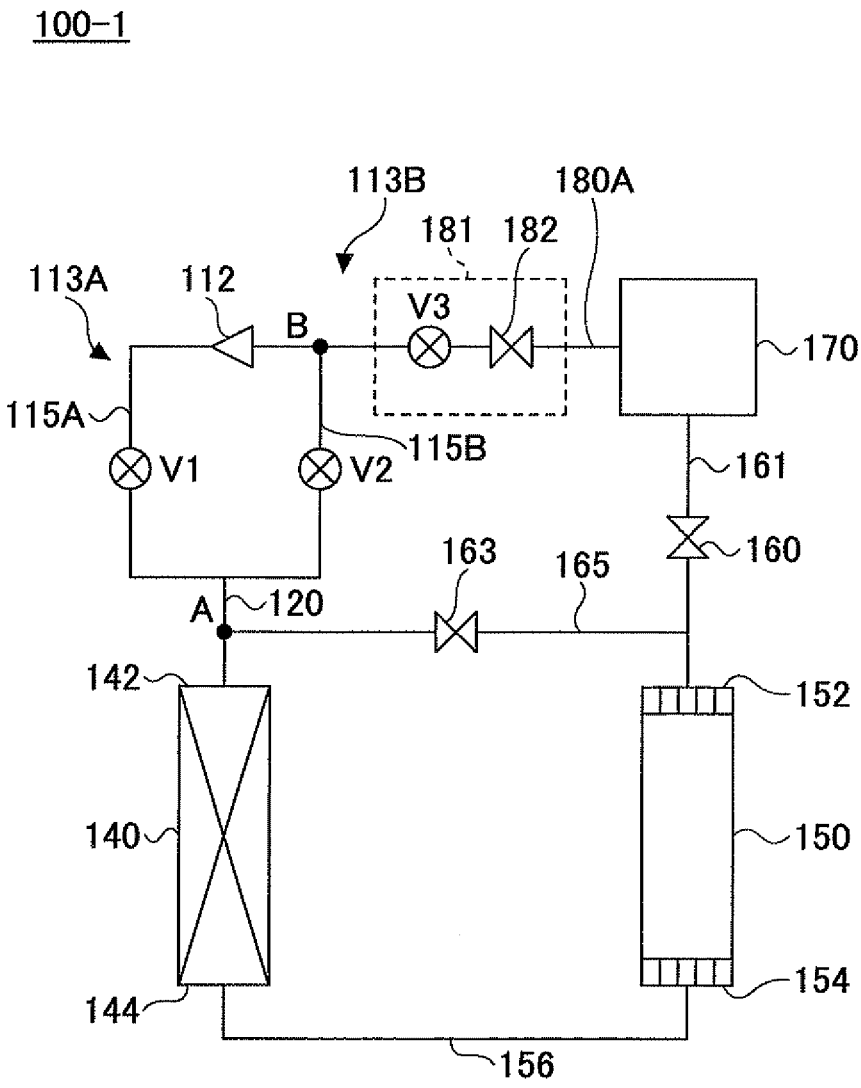
FIG. 3 is a schematic view of an example of a double inlet type pulse tube refrigerator of a first embodiment of the present invention.

FIG. 3 is a schematic view of an example of a double inlet type pulse tube refrigerator of a first embodiment of the present invention.

As shown in FIG. 3, a double inlet type pulse tube refrigerator 100-1 of the first embodiment of the present invention includes a compressor 112, a regenerator 140, a pulse tube 150, a buffer tank 170 and pipes connected to them.

The regenerator 140 includes a high temperature end 142 and a low temperature end 144. The pulse tube 150 includes a high temperature end 152 and a low temperature end 154. A heat exchanger is provided at each of the high temperature end 152 and the low temperature end 154 of the pulse tube 150. The low temperature end 144 of the regenerator 140 and the low temperature end 154 of the pulse tube 150 are connected to each other by the connecting pipe 156. In addition, the buffer tank 170 is connected to the high temperature end 152 of the pulse tube 150 via a pipe 161 having a first flow path resistance member 160 such as an orifice.

A coolant flow path 113A at a high pressure side (discharge side) of the compressor 112 includes a common pipe 120 and a high pressure side pipe 115A where an opening and closing valve V1 is connected. The coolant flow path 113A is connected to the high temperature end 142 of the regenerator 140. On the other hand, a coolant flow path 113B at a low pressure side (intake side) of the compressor 112 includes the common pipe 120 and a low pressure side pipe 115E where an opening and closing valve V2 is connected. The coolant flow path 113B is connected to the high temperature end 142 of the regenerator 140.

The high temperature end 142 of the regenerator 140 and the high temperature end 152 of the pulse tube 150 are connected to each other by a bypass pipe 165 having a double inlet valve 163 such as an orifice.

In addition, the buffer tank 170 is connected to the low pressure side pipe 115B of the compressor 112 at a point B shown in FIG. 3 via a second low pressure side pipe 180A. A second flow path resistance member 181 is provided at the second low pressure side pipe 180A. Although the second flow path resistance member 181 is formed by an opening and closing valve V3 and a fluid amount control valve 182 in the example shown in FIG. 3, the fluid amount control valve 182 may be omitted in the second flow path resistance member 181.

Next, an operation of the double inlet type pulse tube refrigerator 100-1 shown in FIG. 3 is discussed with reference to FIG. 4. Here, FIG. 4 is a graph showing, in time series, opening and closing states of three valves V1 through V3 when the double inlet type pulse tube refrigerator 100-1 shown in FIG. 3 is operated.

(First Step: Time 0 Through t1)

Figure 4:
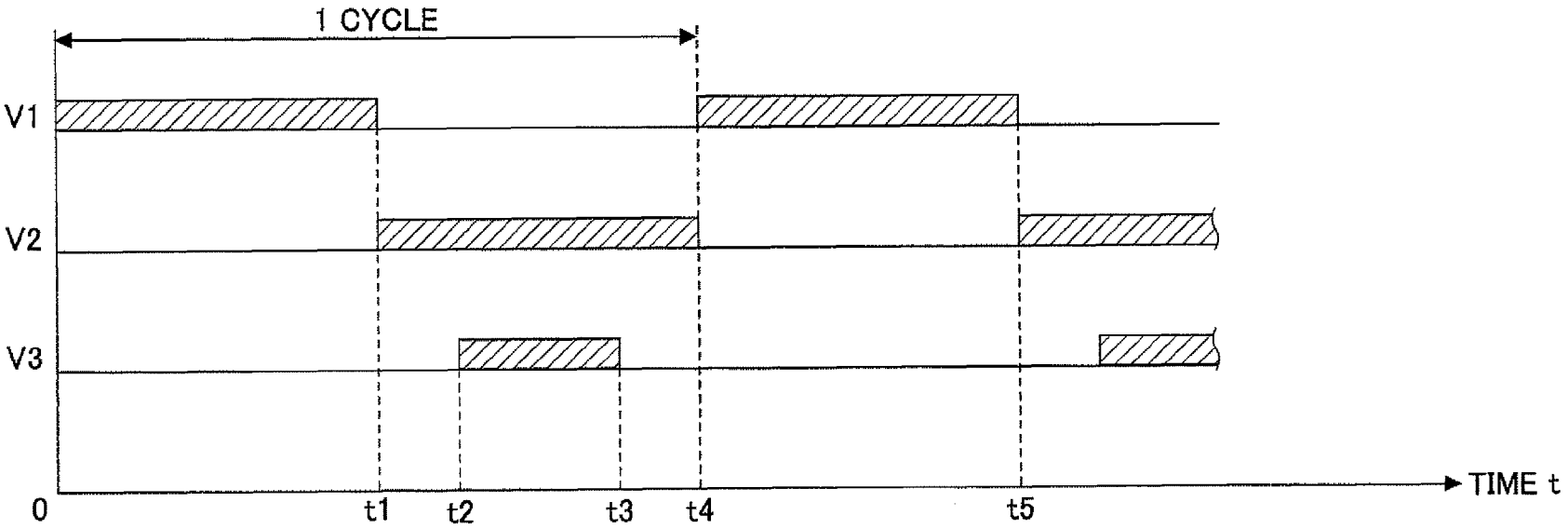
FIG. 4 is a graph showing, in time series, opening and closing states of three valves when the double inlet type pulse tube refrigerator shown in FIG. 3 is operated.

As shown in FIG. 4, in a coolant gas supplying step (step of supplying the coolant gas) where the time t is equal to or greater than 0 (zero) and equal to or less than t1, the opening and closing valve V1 is opened. As a result of this, a high pressure coolant gas from the compressor 112 is supplied to the pulse tube via the coolant gas flow path 113A at the high pressure side, namely the high pressure side pipe 115A and the common pipe 120, the regenerator 140, and the connecting pipe 156. A part of the coolant gas from the common pipe 120 is split at a point A so as to be supplied from the bypass pipe 165 having the double inlet valve 163 into the pulse tube 150 via the high temperature end 152. Because of this, pressure in the pulse tube 150 is increased so that a part of the coolant gas passes through the pipe 161 so as to be received in the buffer tank 170.

(Second Step: Time T1 Through T4)

Next, in a coolant gas receiving step (step of receiving the coolant gas) where the time t is equal to or greater than t1 and equal to or less than t4, after the opening and closing valve V1 is closed, the opening and closing valve V2 is opened (t=t1). As a result of this, the coolant gas in the pulse tube 150 passes through the low temperature end 154 of the pulse tube 150, the connecting pipe 156, and the regenerator 140, so as to start being received in the compressor 112 via the coolant flow path 113E at the low pressure side, namely the common pipe 120 and the low pressure side pipe 115B. In addition, a part of the coolant gas in the pulse tube 150 passes through the high temperature end 152 of the pulse tube 150 and the bypass tube 165 so as to be received by the compressor 112 via the point A of the common pipe 120 through the low pressure side pipe 115B. As a result of this, the pressure in the pulse tube 150 is reduced.

After that, when the time t becomes t2, while the opening and closing valve V2 remains open, the opening and closing valve V3 is opened. The timing when the opening and closing valve V3 is opened may be equal to the timing when the opening and closing valve V2 is opened (in other words, t2 may be equal to t1). Because of this, the coolant gas received in the buffer tank 170 passes through the second low pressure side pipe 180A and is received by the compressor 112. In addition, since the pressure in the buffer tank 170 is reduced, a part of the coolant gas in the pulse tube 150 passes through the pipe 161 so as to move toward the buffer tank 170. Accordingly, the pressure in the pulse tube 150 is further decreased.

After that, when the time t becomes t3, while the opening and closing valve V2 remains open, the opening and closing valve V3 is closed. And then, when the time t becomes t4, the opening and closing valve V2 is closed so that the receiving step of the coolant gas is completed. The timing when the opening and closing valve V3 is closed may be equal to the timing when the opening and closing valve V2 is closed (in other words, t3 may be equal to t4).

By repeating the above-mentioned steps (t=0 through t4) as a one cycle, compression/expansion of the coolant gas is repeatedly generated in the pulse tube 150, and thereby a cryogenic state is formed at the low temperature end 154 of the pulse tube 150. In addition, a cooling subject provided at the low temperature end 154 of the pulse tube 150 (not shown in FIG. 3) can be cooled.

As discussed above with reference to FIG. 1, in the related art double inlet type pulse tube refrigerator, in a supplying step/receiving step of the coolant gas, a secondary flow (indicated by an arrow L in FIG. 1) of the coolant gas may be easily generated due to imbalance of a flow amount of the coolant gas flowing through the double inlet valve 63. The secondary flow of the coolant gas circulates in, for example, a closed circuit formed by the bypass pipe 65 having the double inlet valve 63, the pulse tube 50, the connecting pipe 56, and the regenerator 40. Such a secondary flow is a flow in a single direction and may cause a reduction in heat transfer. Hence, if the secondary flow is generated, cooling capacity of the refrigerator may be drastically reduced.

On the other hand, in the double inlet type pulse tube refrigerator 100-1 of the first embodiment of the present invention, the second low pressure side pipe 180A having the second flow path resistance member 181 is provided between the buffer tank 170 and the compressor 112. Therefore, it is possible to prevent or drastically restrain the generation of the secondary flow of the coolant gas discussed above.

In addition, in the double inlet type pulse tube refrigerator 100-1 of the first embodiment of the present invention, the second low pressure side pipe 180A has the second flow path resistance member 181 having the opening and closing valve V3 (the fluid amount control valve 182). This opening and closing valve V3 is closed during a time when the opening and closing valve V1 is opened as in the first step.

Accordingly, in the double inlet type pulse tube refrigerator 100-1 of the first embodiment of the present invention, it is possible to avoid the above-discussed problem of the pulse tube refrigerator 10' shown in FIG. 2, where the part of the coolant gas which is cooled by the regenerator 40 and introduced into the pulse tube 50 passes through the pipe 61, the buffer tank 70 and the other pipe 74 so as to be discharged toward the compressor 12 before working in a next receiving step. Because of this, in the double inlet type pulse tube refrigerator 100-1 of the first embodiment of the present invention, reduction of cooling efficiency of the regenerator 140 can be restrained. In addition, as a result of this, the reduction of the cooling capacity of the entire pulse tube refrigerator can be restrained.

In the above-discussed example, each of the opening and closing valves V1 through V3 shown in FIG. 3 is used as a different opening and closing valve. However, the present invention is not limited to this example. For example, these valves may be formed by a unified single valve assembly. As an example of the single valve assembly, a unique valve can be used. By using the unique valve, it is possible to uniquely define opening and closing states of plural valves in terms of a mechanical structure, namely, a positional relationship between a structural member and an opening or a groove. Such a unique valve includes a rotary valve, a spool valve, and other valves. In a case of the above-mentioned single valve assembly, it is not necessary to properly detect the opening and closing states of each of the opening and closing valves V1 through V3 and to make feedback in order that the opening and closing timing of each of the opening and closing valves V1 through V3 be consistent with the opening and closing timing shown in, for example, FIG. 4. In this case, an apparatus for detecting or feedback control or the like can be omitted so that it is possible to make the pulse tube refrigerator have a simple structure and/or manufacture the pulse tube refrigerator with a low cost.

Second Embodiment

Figure 5:
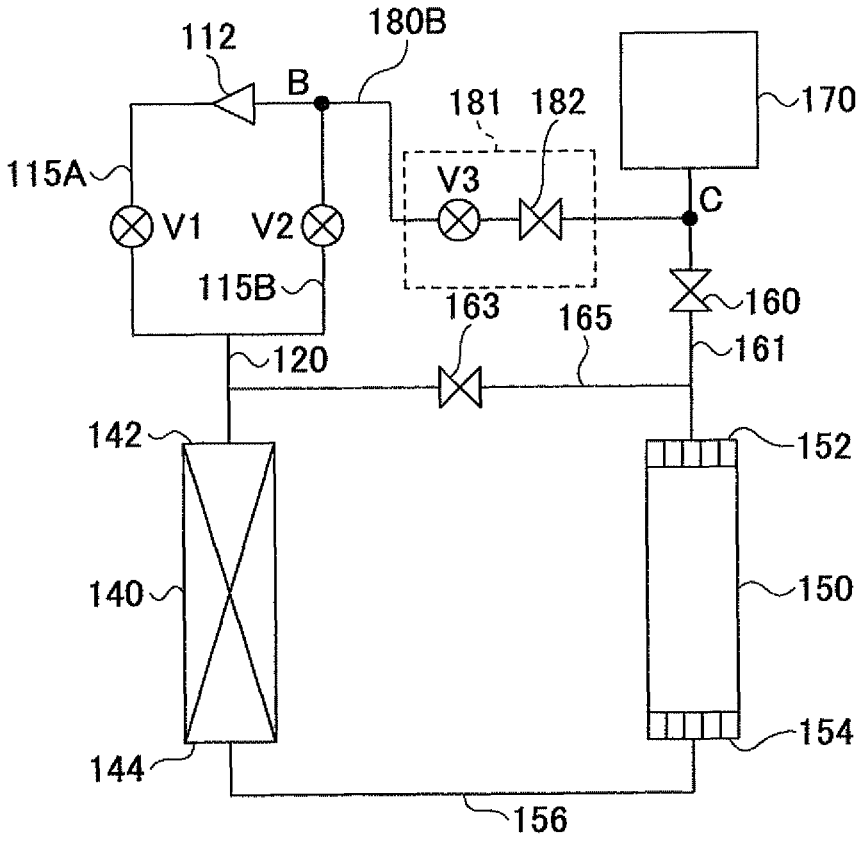
FIG. 5 is a schematic view of an example of a double inlet type pulse tube refrigerator of a second embodiment of the present invention.

FIG. 5 is a schematic view of an example of a double inlet type pulse tube refrigerator of a second embodiment of the present invention.

A double inlet type pulse tube refrigerator 100-2 of the second embodiment of the present invention has a structure similar to that of the double inlet type pulse tube refrigerator 100-1 of the first embodiment. Accordingly, in FIG. 5, parts that are the same as the parts shown in FIG. 3 are given the same reference numerals, and explanation thereof is omitted.

In this example, unlike the example shown in FIG. 3, one end of the second low pressure side pipe 180B having the second flow path resistance member 181 is connected to a point C of the pipe 161 having the first flow path resistance member 160.

This double inlet type pulse tube refrigerator 100-2 can achieve at least two effects achieved by the double inlet type pulse tube refrigerator 100-1, namely restraint of generation of the secondary flow and restraint of reduction of the cooling efficiency. Therefore, in the embodiments of the present invention, one end of the second low pressure side pipe 180A or 1808, for example the point C in FIG. 5, may be connected to any portion of the pipe 161 between the high temperature end 152 of the pulse tube 150 and the buffer tank 170.

Third Embodiment

Figure 6:
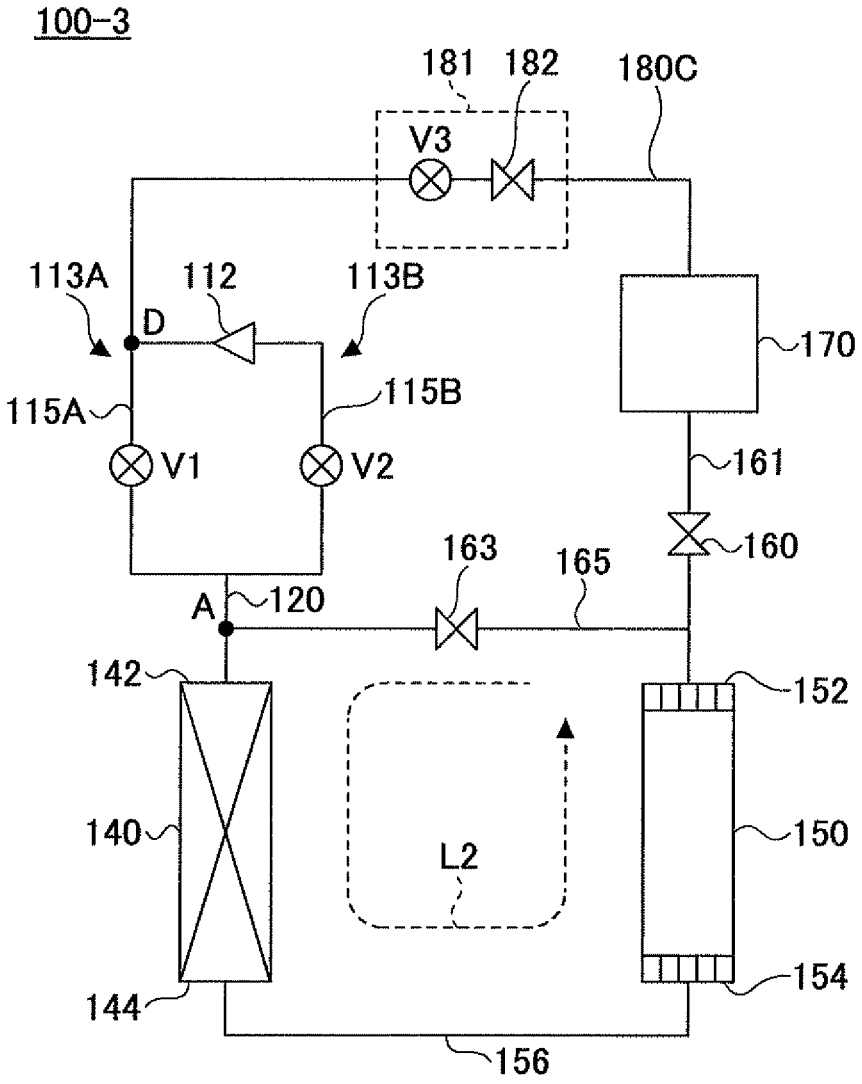
FIG. 6 is a schematic view of an example of a double inlet type pulse tube refrigerator of a third embodiment of the present invention.

FIG. 6 is a schematic view of an example of a double inlet type pulse tube refrigerator of a third embodiment of the present invention.

A double inlet type pulse tube refrigerator 100-3 of the third embodiment of the present invention has a structure similar to that of the double inlet type pulse tube refrigerator 100-1 of the first embodiment. Accordingly, in FIG. 6, parts that are the same as the parts shown in FIG. 3 are given the same reference numerals, and explanation thereof is omitted.

In this example, unlike the example shown in FIG. 3, the second flow path resistance member 181 is provided at a second high pressure side pipe 180C. The second pressure side pipe 180A is not provided. In addition, one end of the second high pressure side pipe 180C is connected to a point D of the high pressure side pipe 115A connected to the high pressure side of the compressor 112 and another end of the second high pressure side pipe 180C is connected to the buffer tank 170.

Next, an operation of the double inlet type pulse tube refrigerator 100-3 shown in FIG. 6 is discussed with reference to FIG. 7. Here, FIG. 7 is a graph showing, in time series, opening and closing states of three valves V1 through V3 when the double inlet type pulse tube refrigerator 100-3 shown in FIG. 6 is operated.

(First Step: Time 0 Through T3)

Figure 7:
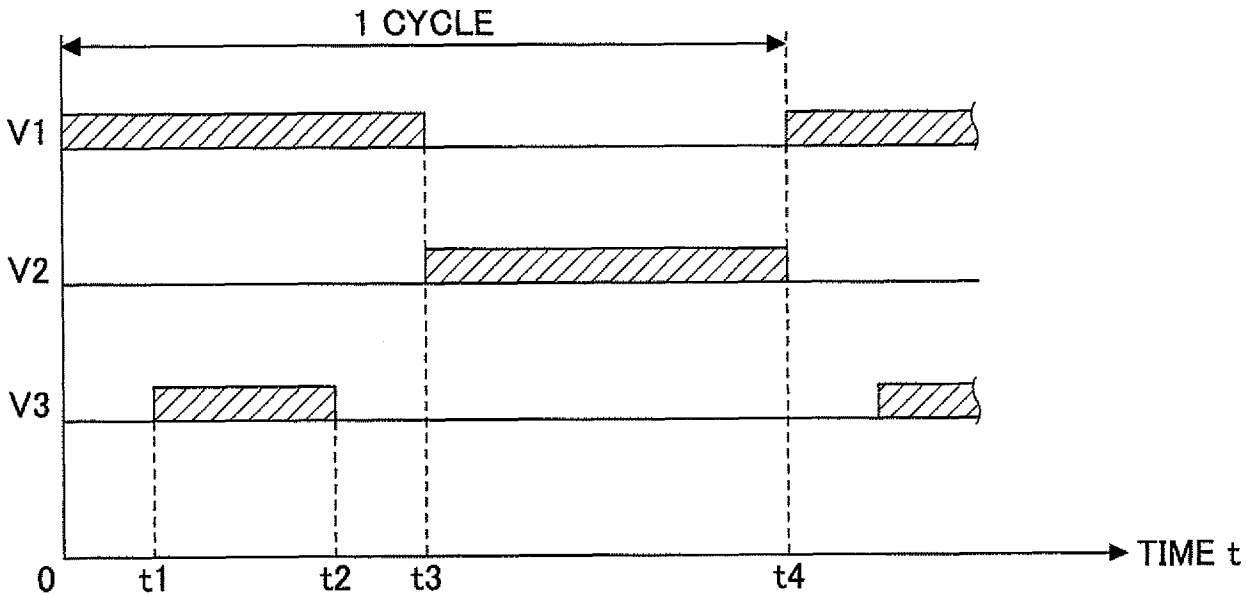
FIG. 7 is a graph showing, in time series, opening and closing states of three valves when the double inlet type pulse tube refrigerator shown in FIG. 6 is operated.

As shown in FIG. 7, in a coolant gas supplying step (step of supplying the coolant gas), the opening and closing valve V1 is opened. As a result of this, a high pressure coolant gas from the compressor 112 is supplied to the pulse tube via the coolant gas flow path 113A at the high pressure side, namely the high pressure side pipe 115A and the common pipe 120, the regenerator 140, and the connecting pipe 156. A part of the coolant gas from the common pipe 120 is split at a point A so as to be supplied from the bypass pipe 165 having the double inlet valve 163 into the pulse tube 150 via the high temperature end 152. Because of this, a pressure in the pulse tube 150 is increased so that a part of the coolant gas passes through the pipe 161 so as to be received in the buffer tank 170.

After that, when the time t becomes t1, while the opening and closing valve V1 remains open, the opening and closing valve V3 is opened. The timing when the opening and closing valve V3 is opened may be equal to the timing when the opening and closing valve V1 is opened (in other words, t1 may be equal to 0 (zero)). Because of this, a part of the coolant gas from the compressor 112 is split at a point D of the high pressure side pipe 115A so as to be received in the buffer tank 170 via the second high pressure side pipe 180C having the second flow path resistance member 181.

After that, when the time t becomes t2, while the opening and closing valve V1 remains open, the opening and closing valve V3 is closed. And then, when the time t becomes t3, the opening and closing valve V1 is closed so that the supplying step of the coolant gas is completed.

(Second Step: Time T3 Through T4)

Next, in a coolant gas receiving step (step of receiving the coolant gas) where the time t is equal to or greater than t3 and equal to or less than t4, after the opening and closing valve V1 is closed, the opening and closing valve V2 is opened (t=t3). As a result of this, the coolant gas in the pulse tube 150 passes through the low temperature end 154 of the pulse tube 150, the connecting pipe 156, and the regenerator 140, so as to start being received in the compressor 112 via the coolant flow path 113B at the low pressure side, namely the common pipe 120 and the low pressure side pipe 115B. In addition, a part of the coolant gas in the pulse tube 150 passes through the high temperature end 152 of the pulse tube 150 and the bypass tube 165 so as to be received by the compressor 112 via the point A of the common pipe 120 through the low pressure side pipe 115B. As a result of this, the pressure in the pulse tube 150 is reduced. In addition, the coolant gas received in the buffer tank 170 passes through the pipe 161 and the bypass pipe 165 so as to be received in the compressor 112.

After that, when the time t becomes t4, the opening and closing valve V2 is closed so that the receiving step of the coolant gas is completed.

Figure 1:
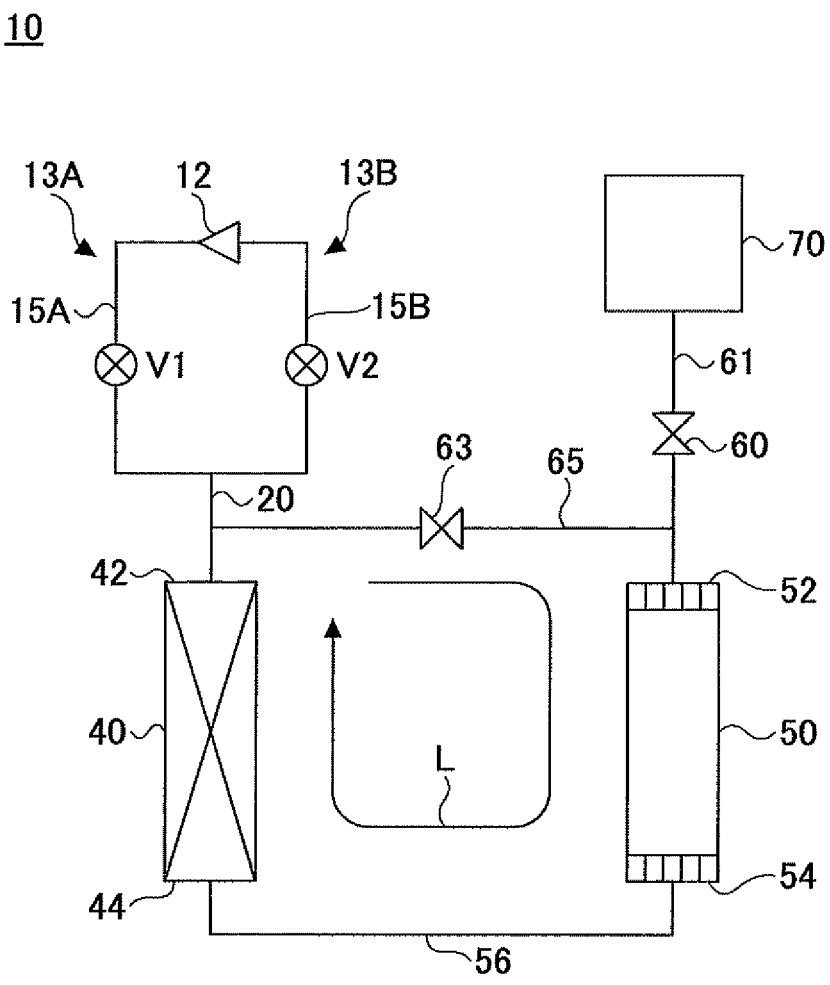
FIG.1 RELATED ART
FIG. 1 is a schematic view of a related art double inlet type pulse tube refrigerator.

The above-discussed double inlet type pulse tube refrigerator 100-3 of the third embodiment of the present invention is effective for restraining a secondary flow of the coolant gas whose direction is opposite to that shown in FIG. 1, namely a flow indicated by a dotted arrow L2 in FIG. 6. The secondary flow indicated by a dotted arrow L2 in FIG. 6 circulates in, for example, a closed circuit formed by the bypass pipe 165 having the double inlet valve 163, the regenerator 140, the connecting pipe 156, and the pulse tube 150. In the double inlet type pulse tube refrigerator 100-3, in the supplying step of the high pressure coolant gas, it is possible to prevent or drastically restrain the generation of the secondary flow of the coolant gas indicated by the dotted arrow L2 in FIG. 6, by the coolant gas flowing in the direction of the compressor 112, the second high pressure side pipe 180C, the buffer tank 170, and the high temperature end 152 of the pulse tube 150.

In the third embodiment, as described above, when the opening and closing valve V2 is opened in the second step (receiving step of the coolant gas), a part of the coolant gas in the pulse tube 150 passes through the connecting pipe 156 and the regenerator 140 from the low temperature end 154 of the pulse tube 150 so as to be returned to the compressor 122 via the coolant flow path 113B at the low pressure side. In addition, a part of the coolant gas in the pulse tube 150 passes through the bypass pipe 165 from the high temperature end 152 of the pulse tube 150 so as to be returned to the compressor 122 via the coolant flow path 113B at the low pressure side. Hypothetically if the second high pressure side pipe 180C does not have the opening and closing valve V3, in the second step, the high pressure coolant gas may pass through the second high pressure side pipe 180C and be introduced into the pulse tube 150 via the buffer tank 170 and the pipe 161. In this case, the temperature of the pulse tube 150 may be increased due to the introduction of the normal temperature coolant gas so that the entire refrigerating efficiency of the pulse tube refrigerator may be decreased.

However, in the third embodiment of the present invention, the second high pressure side pipe 180C has the second flow path resistance member 181 having the opening and closing valve V3 (and the flow amount control valve 182). Therefore, in the third embodiment, as well as the first embodiment and the second embodiment, due to the double inlet type pulse tube refrigerator 100-3, it is possible to restrain the decrease of the entire refrigerating efficiency of the pulse tube refrigerator.

Fourth Embodiment

Figure 8:
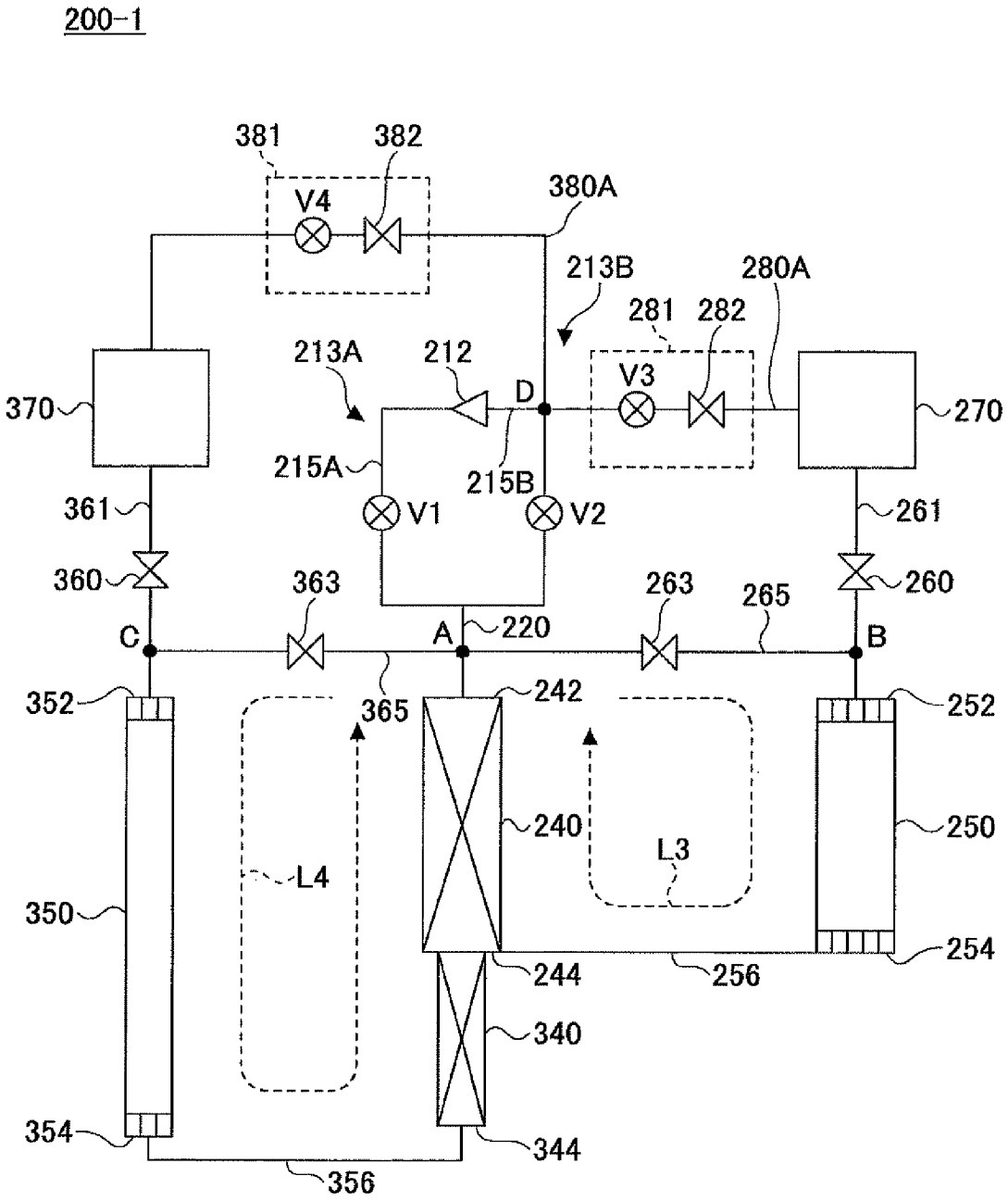
FIG. 8 is a schematic view of an example of a double inlet type pulse tube refrigerator of a fourth embodiment of the present invention.

FIG. 8 is a schematic view of an example of a double inlet type pulse tube refrigerator of a fourth embodiment of the present invention.

As shown in FIG. 8, a double inlet type pulse tube refrigerator 200-1, unlike the above-discussed double inlet type pulse tube refrigerators 100-1 through 100-3, is a two stage double inlet type pulse tube refrigerator.

The double inlet type pulse tube refrigerator 200-1 of the fourth embodiment of the present invention includes a compressor 212, a first stage regenerator 240, a second stage regenerator 340, a first pulse tube 250, a second pulse tube 350, a first buffer tank 270, a second buffer tank 370, and pipes connected to them.

The first stage regenerator 240 includes a high temperature end 242 and a low temperature end 244. The second stage regenerator 340 includes a high temperature end 244 (namely, the low temperature end of the first stage regenerator 240) and a low temperature end 344. The first stage pulse tube 250 includes a high temperature end 252 and a low temperature end 254. The second stage pulse tube 350 includes a high temperature end 352 and a low temperature end 354. Heat exchangers are provided at the high temperature end 252 and the low temperature end 254 of the first stage pulse tube 250 and the high temperature end 352 and the low temperature end 354 of the second stage pulse tube 350. The low temperature end 244 of the first stage regenerator 240 and the low temperature end 254 of the first pulse tube 250 are connected to each other by the connecting pipe 256. The low temperature end 344 of the second stage regenerator 340 and the low temperature end 354 of the second pulse tube 350 are connected to each other by the connecting pipe 356.

The first buffer tank 270 is connected to the high temperature end 252 of the first stage pulse tube 250 via a pipe 261 having a first flow path resistance member 260 such as an orifice. Similarly, the second buffer tank 370 is connected to the high temperature end 352 of the second stage pulse tube 350 via a pipe 361 having a third flow path resistance member 360 such as an orifice.

The high temperature end 242 of the first stage regenerator 240 and the high temperature end 252 of the first pulse tube 250 are connected to each other by a connecting pipe 265 having a double inlet valve 263 such as an orifice. One end of the bypass pipe 265 is connected to a point A of a common pipe 220 mentioned below and another end of the bypass pipe 265 is connected to a point B of the pipe 261. The high temperature end 242 of the first stage regenerator 240 and the high temperature end 352 of the second pulse tube 350 are connected to each other by the bypass pipe 265 having a double inlet valve 363 such as an orifice. One end of a bypass pipe 365 is connected to the point A of the common pipe 220 mentioned below and another end of the bypass pipe 365 is connected to a point C of the pipe 361.

The compressor 212 includes a coolant flow path 213A at a high pressure side (discharge side) and a coolant flow path 213B at a low pressure side (intake side). The coolant flow path 213A at the high pressure side includes the common pipe 220 and a high pressure side pipe 215R where an opening and closing valve V1 is connected. Another end of the common pipe 220 is connected to the high temperature end 242 of the first stage regenerator 240. On the other hand, the coolant flow path 213B at the low pressure side includes the common pipe 220 and a low pressure side pipe 215B where an opening and closing valve V2 is connected.

In addition, the first buffer tank 270 is connected to the low pressure side pipe 215B of the compressor 212 at a point D via a second low pressure side pipe 280A. A second flow path resistance member 281 is provided at the second low pressure side pipe 280A. Although the second flow path resistance member 281 is formed by an opening and closing valve V3 and a fluid amount control valve 282 in the example shown in FIG. 8, the fluid amount control valve 282 may be omitted in the second flow path resistance member 281.

Similarly, the second buffer tank 370 is connected to the low pressure side pipe 215B of the compressor 212 at the point D via a third low pressure side pipe 380A. A fourth flow path resistance member 381 is provided at the third low pressure side pipe 380A. Although the fourth flow path resistance member 381 is formed by an opening and closing valve V4 and a fluid amount control valve 382 in the example shown in FIG. 8, the fluid amount control valve 382 may be omitted in the fourth flow path resistance member 381.

One skilled in the art can easily understand the operation of the double inlet type pulse tube refrigerator 200-1 of the fourth embodiment based on the above-discussed double inlet type pulse tube refrigerators 100-1 through 100-3. Therefore, explanation of the operation of the double inlet type pulse tube refrigerator 200-1 is omitted.

In this structure, it is possible to restrain a secondary flow (indicated by a dotted line arrow L3 in FIG. 8) circulating in a closed circuit formed by the bypass pipe 265 having the double inlet valve 263, the first stage pulse tube 250, the connecting pipe 256, and the first stage regenerator 240 and a secondary flow (indicated by a dotted line arrow L4 in FIG. 8) circulating in a closed circuit formed by the bypass pipe 365 having the double inlet valve 363, the second stage pulse tube 350, the connecting pipe 356, the second stage regenerator 340, and the first stage regenerator 240.

Accordingly, in the double inlet type pulse tube refrigerator 200-1 of the fourth embodiment of the present invention, it is possible to avoid the problem, by properly opening and closing the opening and closing valves V3 and V4, where the part of the coolant gas which is cooled by the first stage and second stage regenerator 240 and 340 and introduced to the first stage and second stage pulse tube 250 and 350 is discharged toward the compressor 212 before working in a next receiving step. Accordingly, according to the fourth embodiment of the present invention, it is possible to provide a double inlet type pulse tube refrigerator having a proper refrigerating efficiency.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

For example, in the double inlet type pulse tube refrigerator 200-1 shown in FIG. 8, either the second low pressure side pipe 280A having the second flow path resistance member 281 or the third low pressure side pipe 380A having the fourth flow path resistance member 381 can be omitted.

Thus, according to the above-discussed embodiments of the present invention, it is possible to provide a double inlet type pulse tube refrigerator whereby it is possible to prevent generation of secondary flow without decreasing cooling efficiency of the entire apparatus.

The present invention can be applied to single stage and multi stage double inlet type pulse tube refrigerators.

What is claimed is:

1. A method of controlling a double inlet type pulse tube refrigerator including a regenerator having a high temperature end and a low temperature end;

a pulse tube having a high temperature end and a low temperature end, the low temperature end being connected to the low temperature end of the regenerator;

a compressor having a high pressure supplying side and low pressure receiving side for a coolant, wherein the high pressure supplying side is connected to the high temperature end of the regenerator via a coolant supplying path having a first opening and closing valve, and the low pressure receiving side is connected to the high temperature end of the regenerator via a coolant receiving path having a second opening and closing valve;

a bypass pipe having a double inlet valve, the bypass pipe being configured to connect the high temperature end of the pulse tube and the high temperature end of the regenerator;

a buffer tank connected to the high temperature end of the pulse tube via a first pipe having a first flow path resistance member; and a second pipe extending from the buffer tank or the first pipe and having a second flow path resistance member, which includes a fluid amount control valve and a third opening and closing valve, the second flow path resistance member of the second pipe being connected with the coolant receiving path at a point existing between the low pressure receiving side of the compressor and the second opening and closing valve, the method comprising:

causing a gas flowing out of the high temperature end of the pulse tube to pass through both the fluid amount control valve and the third opening and closing valve to the point existing between the low pressure receiving side of the compressor and the second opening and closing valve in the coolant receiving path;

opening and closing the third opening and closing valve in association with an opening state of or a closing state of the first opening and closing valve;

opening the second opening and closing valve and closing the first opening and closing valve at a first time point;

during a first period maintaining the second opening and closing valve in an opened state and the first and third opening and closing valves in closed states so as to flow a gas from the low temperature end of the pulse tube through the regenerator and the opened second opening and closing valve to the low pressure receiving side of the compressor, and to flow the gas from the high temperature end of the pulse tube through the bypass pipe and the opened second opening and closing valve to the low pressure receiving side of the compressor;

subsequently maintaining the second opening and closing valve in an opened state and opening the third opening and closing valve at a second time point;

during a second period maintaining the second and third opening and closing valves in opened states and the first opening and closing valve in a closed state so as to additionally flow the gas from the buffer tank through the second pipe and the opened third opening and closing valve to the low pressure receiving side of the compressor;

closing the third opening and closing valve at a third time point; and during a third period maintaining the second opening and closing valve in an opened state and the first and third opening and closing valves in closed states;

wherein the first period is on and after the first time point and before the second time point;

wherein the second period is on and after the second time point and before a third time point and immediately after the first period; and wherein the third period is on and after the third time point and immediately after the second period.

2. The method of controlling a double inlet type pulse tube refrigerator as claimed in claim 1, wherein the first, second, and third opening and closing valves are a single rotary valve or a spool valve.

3. The method of controlling a double inlet type pulse tube refrigerator as claimed in claim 1, wherein one end of the second pipe having the second flow path resistance member is connected with the coolant receiving path at the point, the method further comprising:

maintaining the third opening and closing valve to be closed when the first opening and closing valve is opened; and opening the third opening and closing valve while the first opening and closing valve is closed.

4. The method of controlling a double inlet type pulse tube refrigerator as claimed in claim 1, wherein the double inlet type pulse tube refrigerator is a multi-stage pulse tube refrigerator.

* * * * *